US009001113B2

(12) United States Patent
Guo et al.

(10) Patent No.: US 9,001,113 B2
(45) Date of Patent: Apr. 7, 2015

(54) ORGANIC LIGHT-EMITTING DIODE DISPLAY DEVICE AND PIXEL CIRCUIT THEREOF

(71) Applicant: InnoLux Corporation, Miao-Li County (TW)

(72) Inventors: Gong-Chen Guo, Miao-Li County (TW); Ming-Chun Tseng, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 79 days.

(21) Appl. No.: 13/942,243

(22) Filed: Jul. 15, 2013

(65) Prior Publication Data

US 2014/0022150 A1 Jan. 23, 2014

(30) Foreign Application Priority Data

Jul. 18, 2012 (TW) ..... 101125740 A

(51) Int. Cl.
*G09G 5/00* (2006.01)
*G09G 3/32* (2006.01)

(52) U.S. Cl.
CPC ..... *G09G 3/3233* (2013.01); *G09G 2300/0852* (2013.01); *G09G 2300/0861* (2013.01)

(58) Field of Classification Search
CPC . G09G 3/3208; G09G 3/3233; G09G 3/3258; G09G 2300/0809; G09G 2300/0819; G09G 2320/043; G09G 2320/045
USPC ..... 345/76, 77, 78, 82, 92, 204, 212, 214, 345/690
See application file for complete search history.

(56) References Cited

U.S. PATENT DOCUMENTS

| | | | | |
|---|---|---|---|---|
| 7,642,997 | B2 * | 1/2010 | Hamer et al. | 345/76 |
| 7,760,166 | B2 * | 7/2010 | Uchino et al. | 345/76 |
| 8,558,763 | B2 * | 10/2013 | Kim | 345/76 |
| 2005/0285825 | A1 * | 12/2005 | Eom et al. | 345/76 |
| 2005/0285827 | A1 * | 12/2005 | Eom | 345/76 |
| 2006/0061525 | A1 * | 3/2006 | Kim et al. | 345/76 |
| 2006/0077194 | A1 * | 4/2006 | Jeong | 345/204 |
| 2006/0256057 | A1 * | 11/2006 | Han et al. | 345/92 |
| 2008/0001861 | A1 * | 1/2008 | Asano et al. | 345/77 |
| 2008/0048955 | A1 * | 2/2008 | Yumoto et al. | 345/82 |
| 2008/0136795 | A1 * | 6/2008 | Numao et al. | 345/204 |
| 2010/0103160 | A1 * | 4/2010 | Jeon et al. | 345/213 |

* cited by examiner

*Primary Examiner* — Tom Sheng
(74) *Attorney, Agent, or Firm* — Muncy, Geissler, Olds & Lowe, P.C.

(57) ABSTRACT

An OLED (Organic Light-Emitting Diode) display device and a pixel circuit thereof are disclosed. In a pixel circuit, a driving transistor driving an OLED is controlled for a reset operation and a compensation of the pixel circuit, by which a threshold voltage of the driving transistor is memorized on a control terminal of the driving transistor. In the compensation operation, a connection node between the driving transistor and the OLED is specially controlled. A switch circuit is provided in the pixel circuit. Based on a control signal, the switch circuit couples the connection node to a control voltage level. An enable interval of the control signal covers an enable interval of the reset operation and an enable interval of the compensation operation.

12 Claims, 9 Drawing Sheets

ORGANIC LIGHT-EMITTING DIODE DISPLAY DEVICE AND PIXEL CIRCUIT THEREOF

CROSS REFERENCE TO RELATED APPLICATIONS

This Application claims priority of Taiwan Patent Application No. 101125740, filed on Jul. 18, 2012, the entirety of which is incorporated by reference herein.

BACKGROUND OF THE INVENTION

1. Field of the Invention

The present invention relates to an OLED (organic light-emitting diode) display device and OLED pixel circuit thereof.

2. Description of the Related Art

To drive an OLED, a driving transistor is generally coupled to the OLED to provide the OLED with a driving current. However, the driving transistor may deteriorate with time and a threshold voltage thereof may change with time, which when occurring, the driving current may sporadically deviate and result in incorrect operations of the OLED.

BRIEF SUMMARY OF THE INVENTION

An OLED (organic light-emitting diode) display device and OLED pixel circuit therein are disclosed.

An OLED pixel circuit in accordance with an exemplary embodiment of the invention comprises an OLED, a driving transistor, first to third switch transistors, a capacitor and a switch circuit. The first switch transistor, the driving transistor and the OLED are coupled in series between a first operating voltage terminal and a second operating voltage terminal. The first switch transistor is controlled according to a first signal. The driving transistor has a first terminal coupled to first switch transistor, a second terminal coupled to the OLED, and further has a control terminal. The second switch transistor is coupled between the first terminal and the control terminal of the driving transistor, and is controlled according to a second signal. The third switch transistor, controlled according to a signal at a scan line, is operative to convey a signal from a data line to a circuit node. The capacitor is coupled between the circuit node and the control terminal of the driving transistor. The switch circuit is controlled according to a third signal to couple the second terminal of the driving transistor to a control voltage level.

In an exemplary embodiment, the first signal is enabled in two stages, providing a first stage enable interval and a second stage enable interval. The first stage enable interval of the first signal is prior to an enable interval of the second signal. The second stage enable interval of the first signal is later than a pixel data write interval. An enable interval of the third signal covers the first stage enable interval of the first signal and the enable interval of the second signal. In the enable interval of the second signal, the control voltage level is at a specific voltage level for pulling down a voltage level of the second terminal of the driving transistor.

An OLED display device in accordance with an exemplary embodiment of the invention comprises a pixel array, a driver module and a microcontroller. The pixel array is implemented by the aforementioned pixel circuit. The driver module drives the pixel array to display images. The microcontroller controls the driver module to drive the pixel array.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description shows several exemplary embodiments carrying out the invention. This description is made for the purpose of illustrating the general principles of the invention and should not be taken in a limiting sense. The scope of the invention is best determined by reference to the appended claims.

Figure 1:
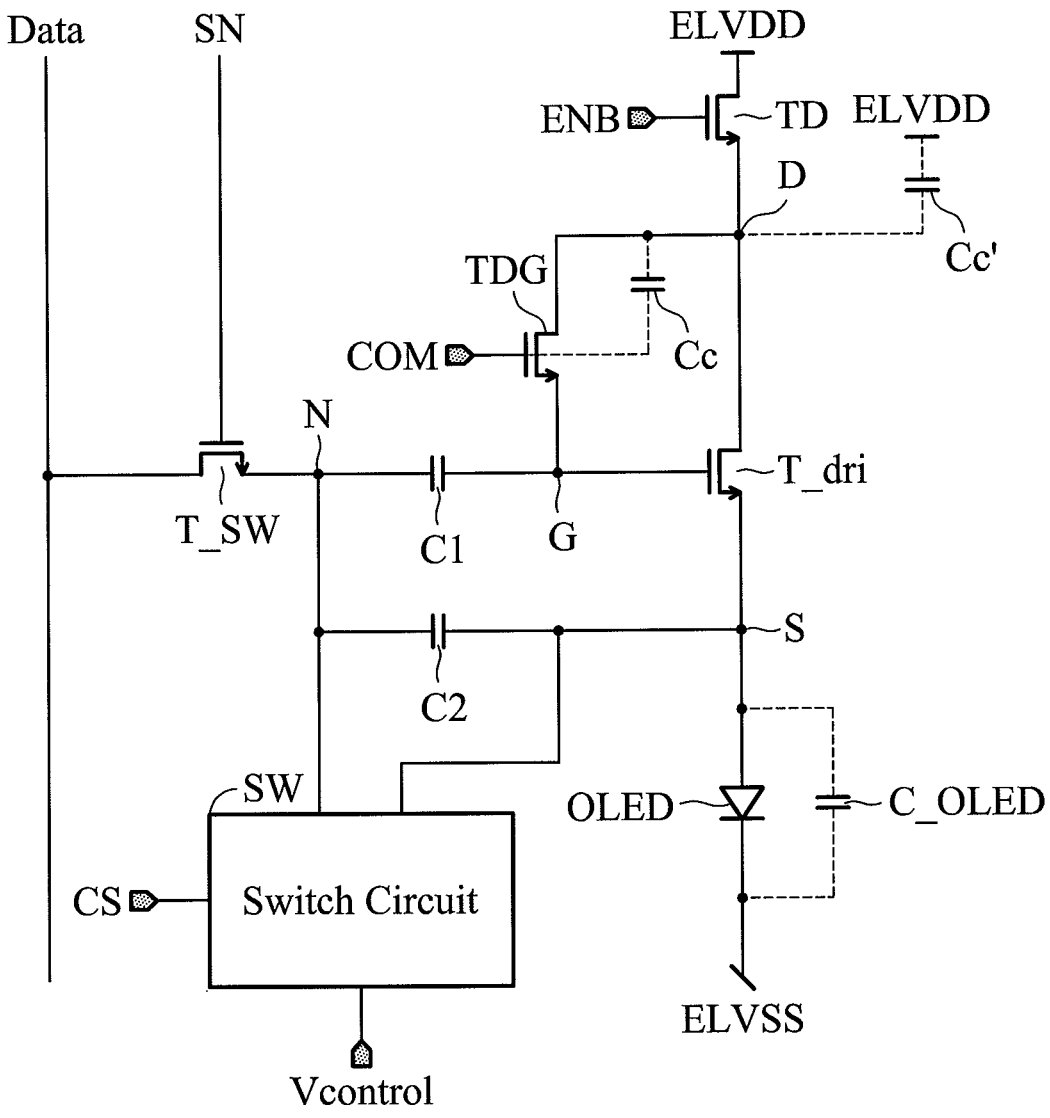
FIG. 1 depicts an OLED pixel circuit in accordance with an exemplary embodiment of the invention.

FIG. 1 illustrates an OLED (organic light-emitting diode) pixel circuit of in accordance with an exemplary embodiment of the invention, which comprises an OLED (also labeled as OLED), a driving transistor T_dri, switch transistors TD, TDG and T_SW, capacitors C1 and C2 and a switch circuit SW. The capacitor C2 is optional, dependent on user requirements. Further, a coupling capacitor (e.g., Cc or Cc') may be added to the pixel circuit as requested by the user. A parasitic capacitor of the OLED is labeled as C_OLED.

As shown, the switch transistor TD and the driving transistor T_dri and the OLED are connected in series between a high power source ELVDD (or named a first operating voltage terminal) and a low power source ELVSS (or named a second operating voltage terminal). The switch transistor TD is controlled according to a first signal ENB. The driving transistor T_dri has a first terminal (e.g. a drain D of an N-type TFT) and a second terminal (e.g. a source S of an N-type TFT) coupled to the switch transistor TD and the OLED, respectively. Further, the driving transistor T_dri has a control terminal (e.g. a gate G of an N-type TFT). The switch transistor TDG is coupled between the first terminal D and the control terminal G of the driving transistor T_dri, and is controlled according to a second signal COM. The switch transistor T_SW is controlled according to a signal from a scan line SN and is operative to convey a signal from a data line Data to a circuit node N. The first capacitor C1 is coupled between the circuit node N and the control terminal G of the driving transistor T_dri. The switch circuit SW is controlled by a third signal CS to couple the second terminal S of the driving transistor T_dri to a control voltage level Vcontrol. In another exemplary embodiment, the circuit node N may be further coupled to the control voltage level Vcontrol via the switch circuit SW according to the third signal CS. The second capacitor C2 (which is an optional capacitor) may be coupled between the second terminal S of the driving transistor T_dri and the circuit node N. The coupling capacitor Cc (which is another optional capacitor) may be coupled between the first terminal D of the driving circuit T_dri and a control terminal (e.g. a gate of an N-type TFT) of the switch transistor TDG. The coupling capacitor Cc' (which is another optional capacitor) may couple the first terminal D of the driving transistor T_dri to the high power source ELVDD or to the low power source ELVSS or to a reference power source named VREF.

Following, design of the switch circuit SW is described. The third signal CS is enabled in an interval different from enable intervals of the first signal ENB and the second signal COM.

Figure 2A:
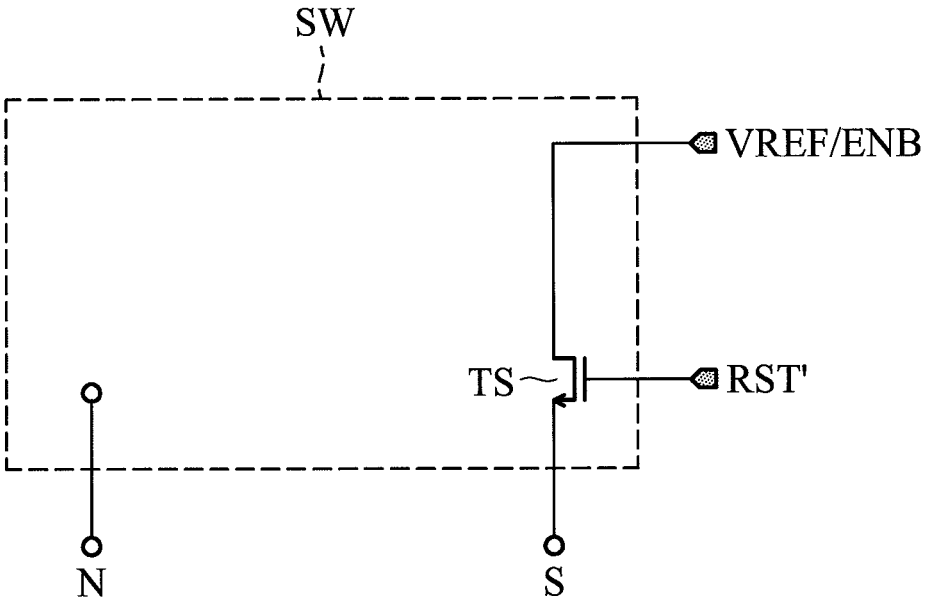
FIG. 2A depicts a switch circuit SW in accordance with an exemplary embodiment of the invention.

FIG. 2A depicts a switch circuit SW in accordance with an exemplary embodiment of the invention, which comprises a switch transistor TS. A signal RST' works as the third signal CS. The signal at the reference power source terminal VREF or the first signal ENB (which is at a specific voltage level, such as ELVSS, when the signal RST' is enabled) may be utilized to provide the control voltage level Vcontrol for pulling down the voltage level of the second terminal S of the driving transistor T_dri. As shown, the switch transistor TS is operated according to the signal RST' to couple the second terminal S of the driving transistor T_dri to the reference power source VREF or to the first signal ENB.

Figure 2B:
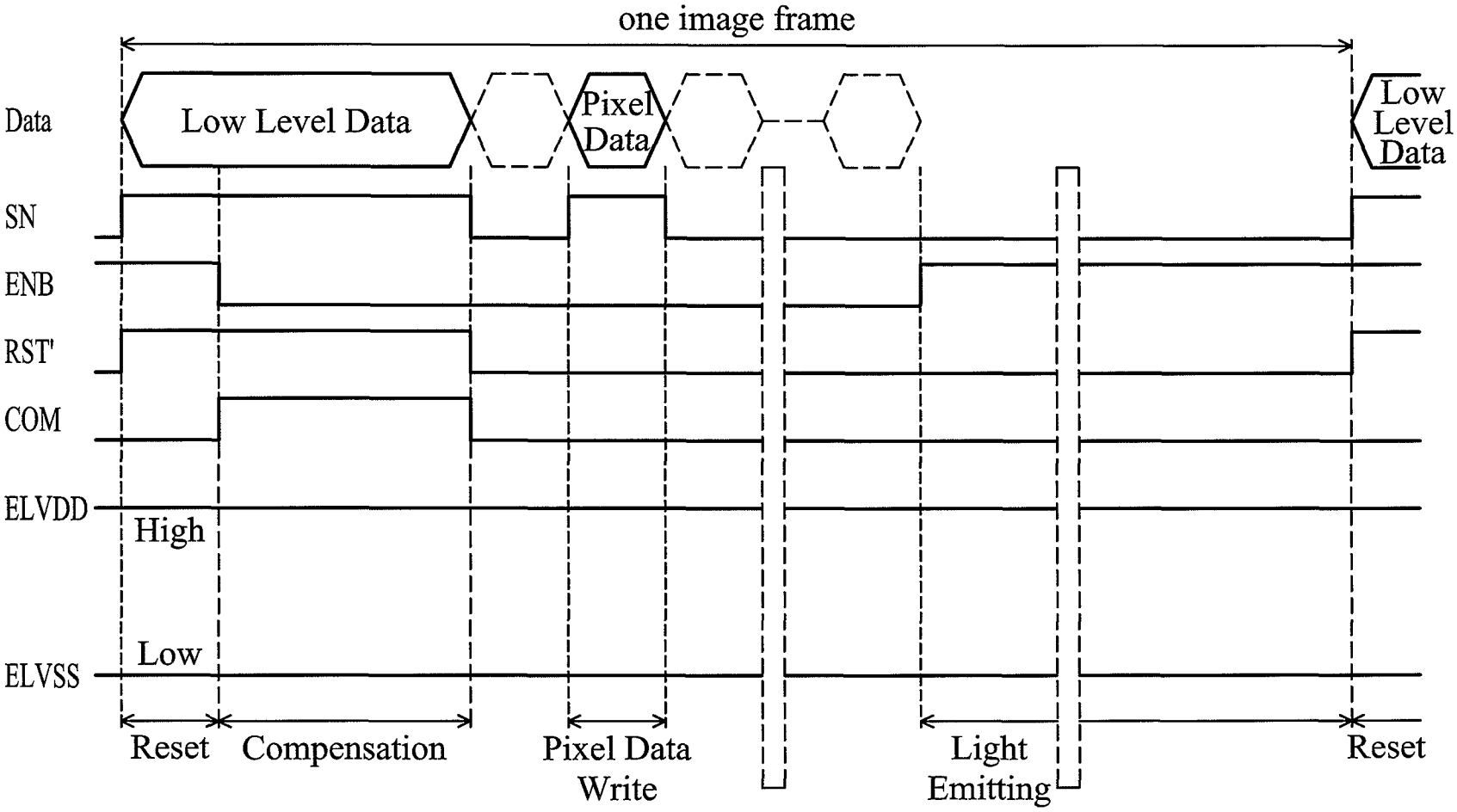
FIG. 2B shows waveforms of signals driving the pixel circuit of FIG. 1 to display a frame of image, wherein the switch circuit SW is implemented by that shown in FIG. 2A and a reset operation, a compensation operation, a pixel data write operation and a light-emitting operation are performed on the pixel circuit.

FIG. 2B shows waveforms of signals driving the pixel circuit of FIG. 1 to display a frame of image, wherein the switch circuit SW is implemented by that shown in FIG. 2A and a reset operation, a compensation operation, a pixel data write operation and a light-emitting operation are performed on the pixel circuit. As shown, the first signal ENB is enabled in two stages, providing a first stage enable interval and a second stage enable interval. The first stage enable interval of the first signal ENN is designed for the reset operation. An enable interval of the second signal COM is arranged to be later than the first stage enable interval of the first signal ENB, to perform the compensation operation on the pixel circuit. The pixel data write operation is performed in a pixel data write interval after the reset and compensation operations are finished. The light-emitting operation is performed after the pixel data write interval is finished. The light-emitting operation starts with a second stage enable interval of the first signal ENB.

Referring to FIG. 2B, the enable interval of the signal RST' covers the time duration of the reset operation and the compensation operation. During the reset and compensation operations, the signal at the scan line SN is enabled and the data line Data conveys a voltage data corresponding to the reference power source VREF (i.e. a low level data). During the pixel data write operation, the signal at the scan line SN is enabled again, and the data line Data conveys a pixel data for driving the OLED to emit light.

FIGS. 3A, 3B, 3C and 3D depict the different states of the driving transistor T_dri with respect to a reset operation, a compensation operation, a pixel data write operation and a light-emitting operation. The different operations are described with reference to the pixel circuit of FIG. 1 and the switch circuit SW of FIG. 2A and the signal control scheme of FIG. 2B. The reference power source VREF is selected to be coupled to the switch transistor TS of FIG. 2A as a source of the control voltage level Vcontrol. Further, for convenience of explanation, the second capacitor C2 is taken into account in the description.

Figure 3A:
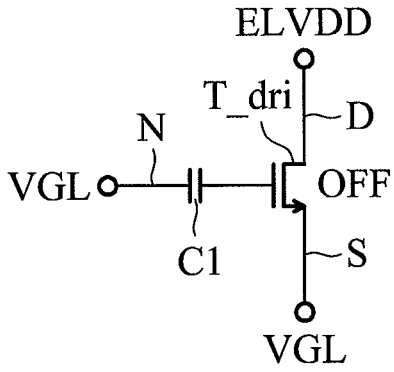
FIGS. 3A, 3B, 3C and 3D depict the different states of the driving transistor T_dri with respect to a reset operation, a compensation operation, a pixel data write operation and a light-emitting operation.

The reset operation is described with reference to FIG. 3A. According to the enabled first signal ENB, the switch transistor TD is turned on and the first terminal D of the driving transistor T_dri is coupled to the high power source ELVDD. According to the enabled signal RST', the second terminal S of the driving transistor T_dri is coupled to the reference power source VREF to be biased at a low voltage level VGL. According to the enabled signal at the scan line SN, the low level data at the data line Data is coupled to bias the circuit node N at the low voltage level VGL as well. Thus, the control terminal G of the driving transistor T_dri is coupled down such that the driving transistor T_dri is turned off ("OFF").

Figure 3B:
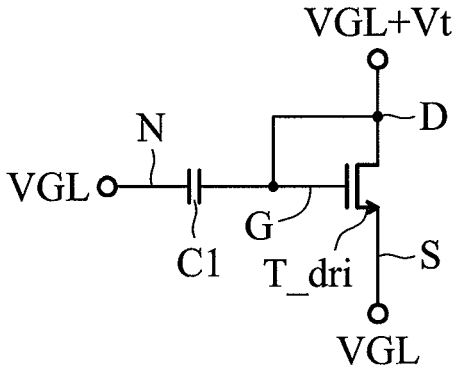

The compensation operation is described with reference to FIG. 3B. The disabled first signal ENB turns off the switch transistor TD, such that the first terminal D of the driving transistor T_dri does not bind to the high power source ELVDD. The signal at the scan line SN is still enabled such that the low level data at the data line Data continuously maintains the circuit node N at the low voltage level VGL. The enabled second signal COM turns on the switch transistor TDS to short the first terminal D and control terminal G of the driving transistor T_dri and thereby the driving transistor T_dri is diode-connected. The signal RST' is maintained to be enabled to continuously couple the second terminal S of the driving transistor T_dri to the low voltage level VGL. In this manner, the first terminal D of the driving transistor T_dri is discharged from a high voltage level (e.g. ELVDD shown in FIG. 3A) to (VGL+Vt). Via the connected terminals G and D, the control terminal G of the driving transistor T_dri is at the voltage level (VGL+Vt) as well Thus, a threshold voltage of the driving transistor T_dri, Vt, is memorized on the capacitor C 1 coupled at the control terminal G of the driving transistor T_dri.

When the pixel circuit is switched from the reset operation to the compensation operation (i.e., the first signal ENB is switched from high to low and the second signal COM is switched from low to high), some terminals of the pixel circuit may be shifted due to the voltage coupling effect. The coupling capacitors Cc and Cc' protect the first terminal D of the driving transistor T_dri from being affected by the disable transition of the first signal ENB. The first terminal D of the driving transistor T_dri is maintained at the high voltage level ELVDD before being discharged by the compensation operation. Further, when the second signal COM is switched to high, the voltage boost is coupled to the first terminal D of the driving transistor T_dri via the coupling capacitor Cc.

Figure 3C:
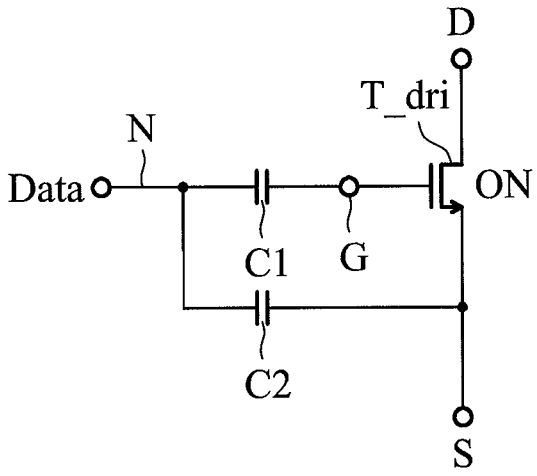

The pixel data write operation is described with reference to FIG. 3C. The first signal ENB is kept disabled, to protect the first terminal D of the driving transistor T_dri from being affected by the high power source. The second signal COM is disabled to turn off the switch transistor TDG such that the driving transistor T_dri is not diode-connected. The third signal RST' is disabled to break off the connection between the second terminal S of the driving transistor T_dri and the reference power source VREF. The signal at the scan line SN is enabled such that a pixel data (marked by Data, the same symbol as the data line) is conveyed to the circuit node N. Voltage levels V(G) and V(S) at the control terminal G and the second terminal S of the driving transistor T_dri may be calculated based on the voltage coupling effect between the circuit node N and the control terminal G and the second terminal S of the driving transistor T_dri as well as the capacitance product f1 between N and G and the capacitance product f2 between N and S (wherein the first and second capacitors C1 and C2 and the parasitic capacitors Cgs, Cgd and Cox of the transistors are all taken into account), where:

$$V(G)=(\mathrm{VGL}+Vt)+f1\cdot(\mathrm{Data}-\mathrm{VGL});$$

$$V(S)=\mathrm{VGL}+f2\cdot(\mathrm{Data}-\mathrm{VGL});$$

$$f1=C1*(C1^{-1}+C_{PG}^{-1})^{-1},$$

$C_{PG}$ is a parasitic capacitor at the control terminal G; and $$f2=C2*(C2^{-1}+C_{PS}^{-1})^{1-1},$$

$C_{PS}$ is a parasitic capacitor at the second terminal S.

A voltage difference Vgs between the control terminal G and the second terminal S of the driving transistor T_dri is:

$$\mathrm{Vgs}=V(G)-V(S)=(f1-f2)\cdot(\mathrm{Data}-\mathrm{VGL})+Vt.$$

Because ideally the OLED should be turned off and the driving transistor T_dri should be turned on (symbolized by 'ON') in the pixel data write operation, the voltage level V(S) has to be lower than ELVSS+Voled(0) and the voltage difference Vgs has to be greater than Vt, where Volde(0) is an initial voltage level of a just enabled OLED. The capacitances of C1 and C2 may be elaborately designed to meet the preferred pixel data write operation.

In some exemplary embodiments, the enable interval of the signal RST' may be extended to cover the pixel data write interval. In this manner, the second terminal S of the driving transistor T_dri may be fixed at the low voltage level VGL in the pixel data write interval for more stable performance of the pixel circuit.

Figure 3D:
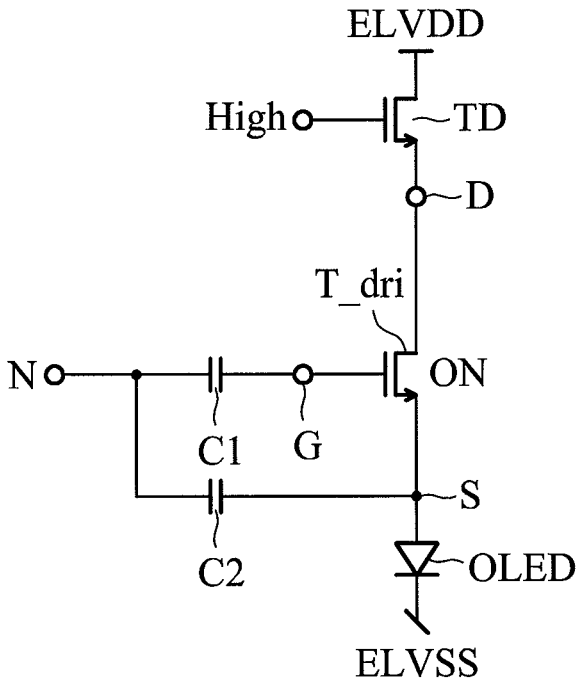

The light-emitting operation is described with reference to FIG. 3D. The signal at the scan line SN is disabled to protect the circuit node N from being affected by the data line. The signal RST' is disabled such that the second terminal S of the driving transistor T_dri does not bind to the control voltage level. At this time, the driving transistor T_dri is still turned on. According to the re-enabled first signal ENB, the switch transistor TD is turned on. Thus, via the switch transistor TD and the driving transistor T_dri, a current flows into the OLED to drive the OLED to emit light. Because of the enabled OLED, the second terminal S of the driving transistor T_dri is at a voltage level V_oled. Voltage levels V(G) at the control terminal G of the driving transistor T_dri may be calculated based on the voltage coupling effect between the second terminal S and the control terminal G of the driving transistor T_dri as well as the capacitance product f3 between S and G (wherein the first and second capacitors C1 and C2 and parasitic capacitors of the transistors are all taken into account), where:

$$V(G)=[(\mathrm{VGL}+Vt)+f1\cdot(\mathrm{Data}-\mathrm{VGL})]+f3\cdot\{V_\mathrm{oled}-[\mathrm{VGL}+f2\cdot(\mathrm{Data}-\mathrm{VGL})]\};$$

$$f3=[(C2^{-1}+C1^{-1})^{-1}]\times[(C2^{-1}+C1^{-1})^{-1}+C_{PG}];\text{ and}$$

$C_{PG}$ represents a parasitic capacitor at the control terminal G. A voltage difference VGS between the control terminal G and the second terminal S of the driving transistor T_dri is V(G)−V(S) and equals to VGL[1−f1−f3+f2·f3]+Data[f1−f2··f3]+(f3−1)V_oled+Vt. Substituting VGS into the current function, I_T_dri=Kp·(Vgs−Vt)$^2$, of the driving transistor T_dri, the time-dependent factor Vt (the threshold voltage) is removed. A current I_oled of the OLED is calculated as:

$$I_\mathrm{oled}=I_T_\mathrm{dri}=Kp\cdot\{\mathrm{VGL}[1-f1-f3+f2\cdot f3]+\mathrm{Data}[f1-f2\cdot f3]+(f3-1)V_\mathrm{oled}\}^2.$$

As shown, the current I_oled is not affected by a deteriorated threshold voltage Vt.

In an exemplary embodiment, the first and second capacitors C1 and C2 are greater than the parasitic capacitor at the control terminal G of the driving transistor T_dri by at least a specific ratio. Thus, the capacitance product f3 approaches 1 and thereby the driving current I_oled is independent of the driving voltage V_oled of the OLED. The light emitting of the OLED is not affected by a deterioration problem of an OLED.

In an exemplary embodiment, a burn-in test is performed on an OLED before being placed in a pixel circuit. Because the deterioration rate of an OLED generally slows down over time, an OLED which has been burn-in tested outputs a stable driving current I_oled.

Note that the second terminal S of the driving transistor T_dri is not limited to being coupled to the reference power source VREF during the reset operation. Alternatively, as shown in FIG. 2A, the first signal ENB may be utilized to provide the control voltage level Vcontrol.

Figure 4A:
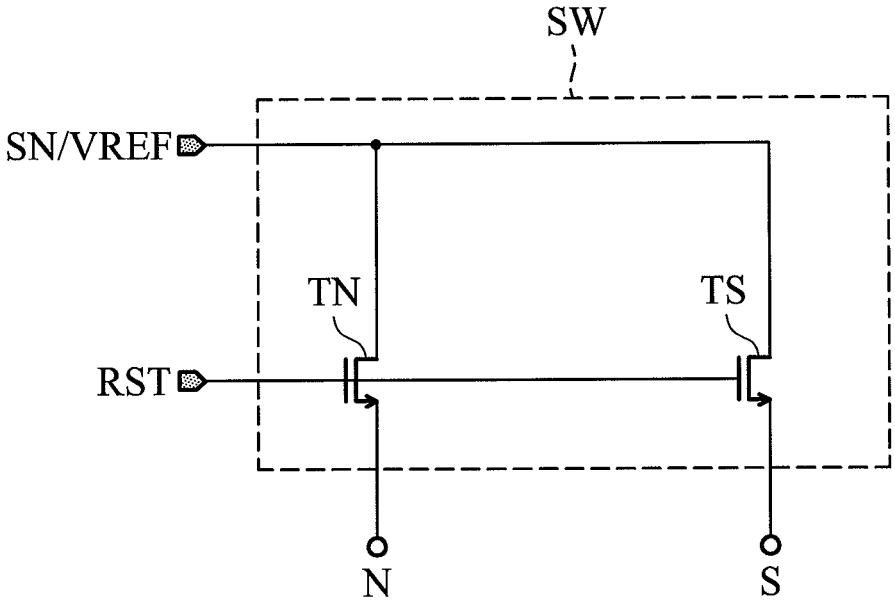
FIG. 4A depicts a switch circuit SW in accordance with another exemplary embodiment of the invention.

FIG. 4A depicts a switch circuit SW in accordance with another exemplary embodiment of the invention, which comprises switch transistors TN and TS. A signal RST works as the third signal CS mentioned with respect to FIG. 1. When the signal RST is enabled, the signal from the scan line SN or from the reference power source VREF is at a specific voltage level (e.g. the voltage level of the low power source ELVSS). Thus, the signal at the scan line SN or from the reference power source VREF may be utilized to pull down the voltage level of the second terminal S of the driving transistor T_dri to the control voltage level Vcontrol mentioned with respect to FIG. 1. As shown, the switch transistor TN couples the circuit node N to the scan line SN or the reference power source VREF according to the signal RST. The switch transistor TS couples the second terminal S of the driving transistor T_dri to the scan line SN or to the reference power source VREF according to the signal RST.

Figure 4B:
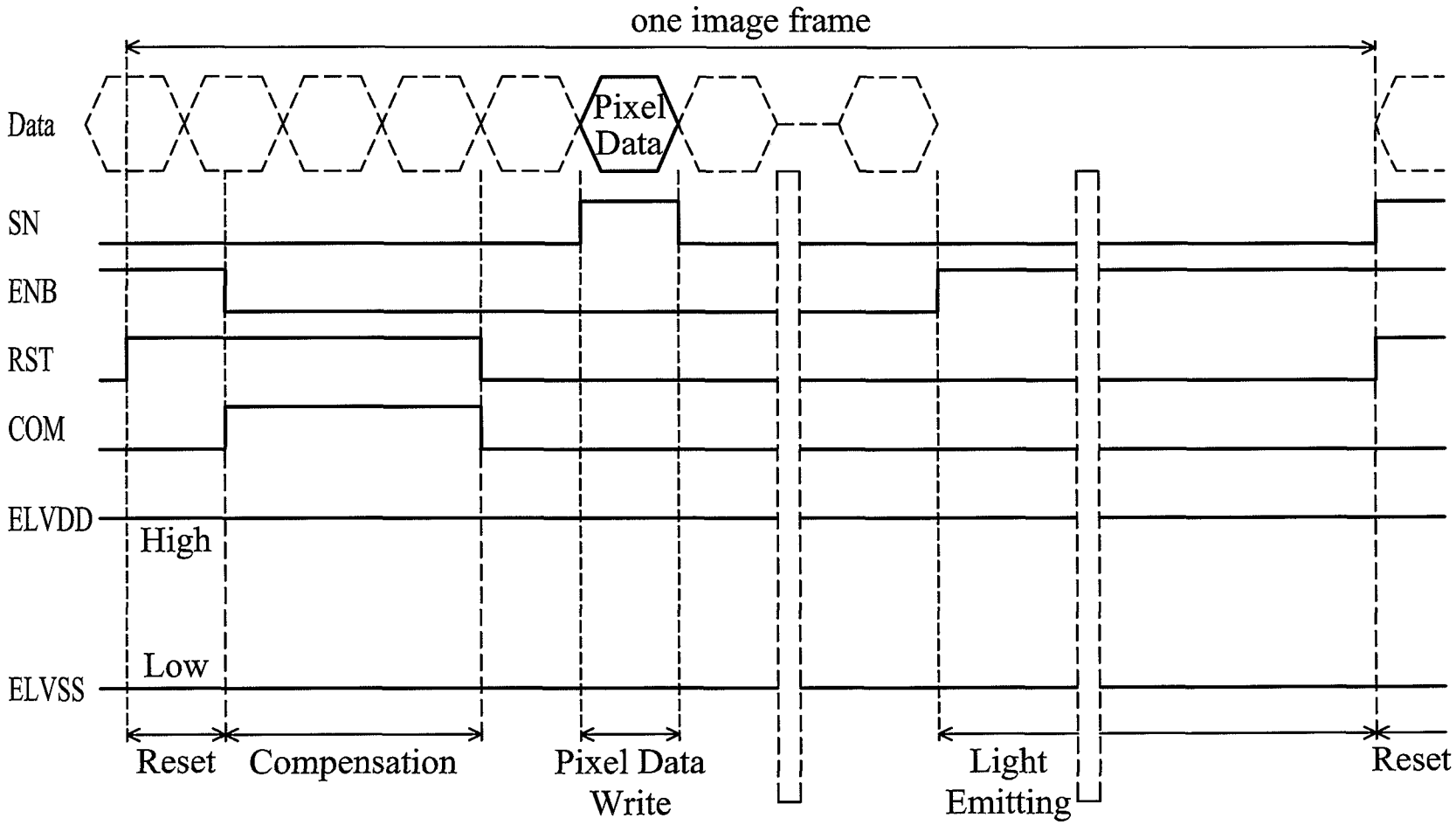
FIG. 4B shows waveforms of signals driving the pixel circuit of FIG. 1 to display a frame of image, wherein the switch circuit SW is implemented by that shown in FIG. 4A and a reset operation, a compensation operation, a pixel data write operation and a light-emitting operation are performed on the pixel circuit.

With the switch circuit of FIG. 4A, FIG. 4B shows signal waveforms for displaying a frame of image. The low voltage level required at the circuit node N during the reset and compensation operations is provided from the enabled switch transistor TN of FIG. 4A (where TN is turned on according to RST). Thus, the scan line SN and data line Data control is independent of the control of the voltage level at the circuit node N. Quite a sufficient time is reserved for the pixel data write operation, which is conducive to implementing a large size screen. Note that the scan line SN is disabled (biased at a low voltage level) during the reset and compensation operations. This is why the scan line SN can be utilized to provide the control voltage level Vcontrol as shown in the switch circuit SW of FIG. 4A.

Figure 5A:
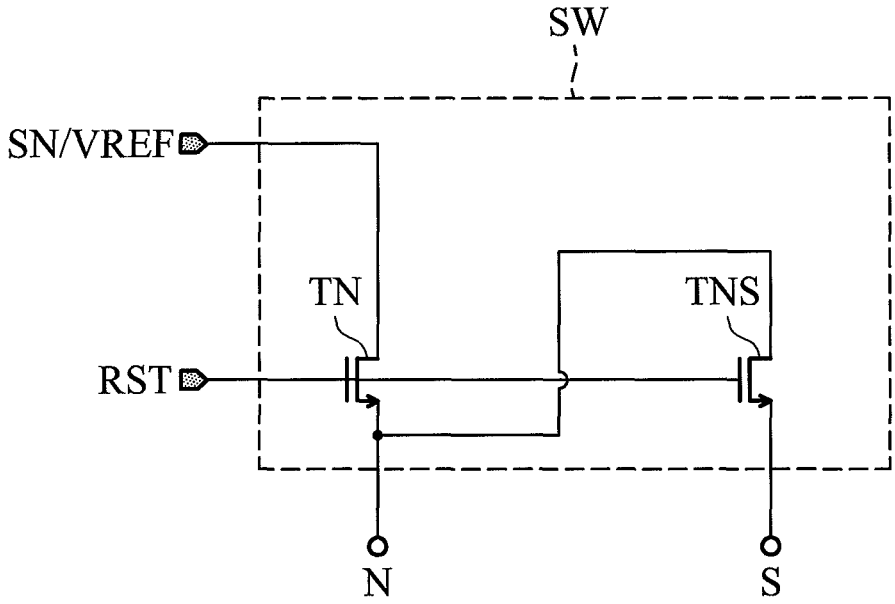
FIGS. 5A and 5B depict switch circuits SW in accordance with other exemplary embodiments of the invention.

FIG. 5A depicts a switch circuit SW in accordance with another exemplary embodiment of the invention, which comprises switch transistors TN and TNS. A signal RST is provided to work as the third signal CS mentioned with respect to FIG. 1. When the signal RST is enabled, the signal at the scan line SN or from the reference power source VREF is at a specific voltage level (e.g. the voltage level of the low power source ELVSS). Thus, the signal at the scan line SN or from the reference power source VREF may be utilized to pull down the voltage level of the second terminal S of the driving transistor T_dri to the control voltage level Vcontrol mentioned with respect to FIG. 1. In this embodiment, the switch transistor TN couples the circuit node N to the scan line SN or the reference power source VREF and the switch transistor TNS couples the circuit node N to the second terminal S of the driving transistor T_dri according to the signal RST.

The switch circuit SW of FIG. 5A may be controlled according to the control scheme depicted in FIG. 4B. Accordingly, a rest operation, a compensation operation, a pixel data write operation and a light-emitting operation are performed on the pixel circuit. The driving transistors T_dri is switched between different states as depicted in FIGS. 3A to 3D.

Figure 5B:
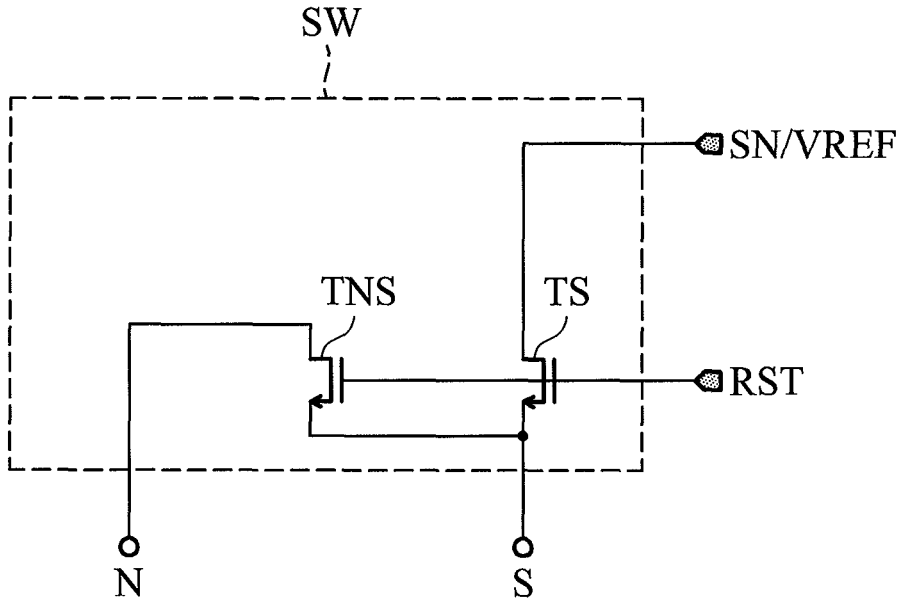

FIG. 5B depicts a switch circuit SW in accordance with another exemplary embodiment of the invention, which comprises switch transistors TNS and TS. A signal RST is provided to work as the third signal CS mentioned with respect to FIG. 1. When the signal RST is enabled, the signal at the scan line SN or from the reference power source VREF is at a specific voltage level (e.g. the voltage level of the low power source ELVSS). Thus, the signal at the scan line SN or from the reference power source VREF may be utilized to pull down the voltage level of the second terminal S of the driving transistor T_dri to the control voltage level Vcontrol mentioned with respect to FIG. 1. In this embodiment, the switch transistor TS couples the second node S of the driving transistor T_dri to the scan line SN or the reference power source VREF and the switch transistor TNS couples the circuit node N to the second terminal S of the driving transistor T_dri according to the control of the signal RST.

The switch circuit SW of FIG. 5B may be controlled according to the control scheme depicted in FIG. 4B. Accordingly, a rest operation, a compensation operation, a pixel data write operation and a light-emitting operation are performed on the pixel circuit. The driving transistors T_dri is switched between different states as depicted in FIGS. 3A to 3D.

Figure 6:
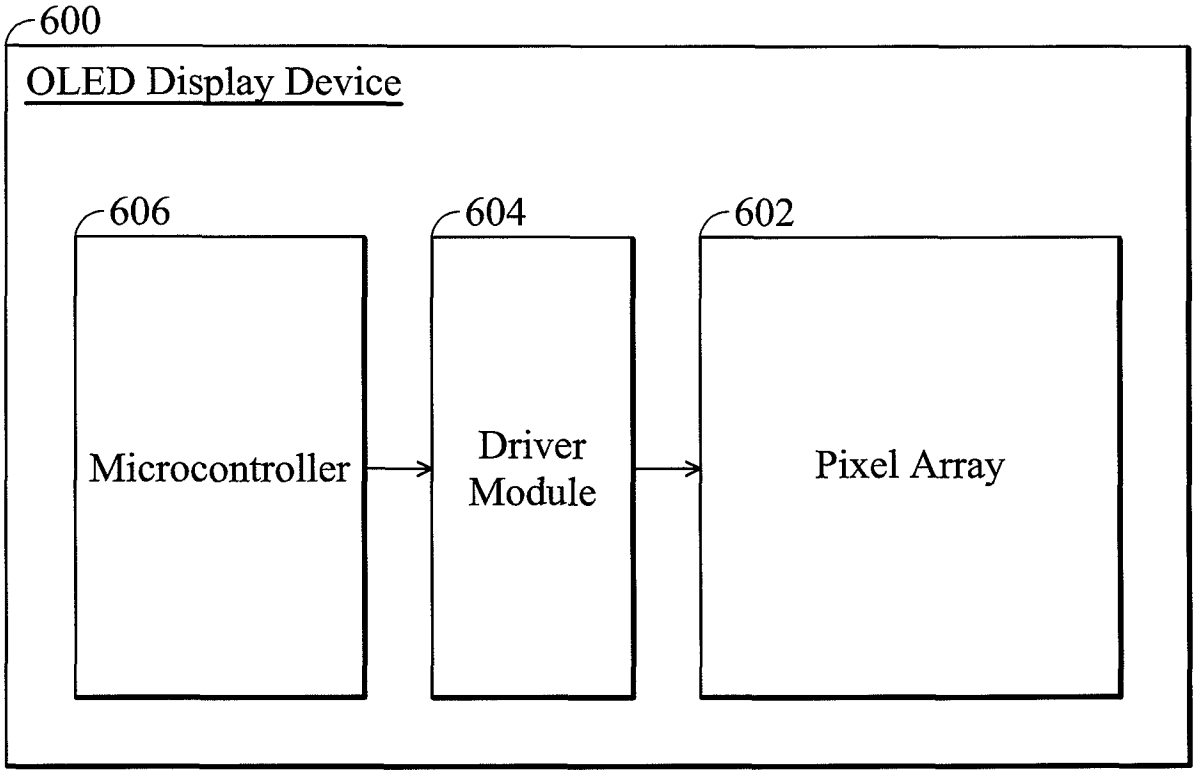
FIG. 6 depicts an OLED display device 600 in accordance with an exemplary embodiment of the invention.

FIG. 6 depicts an OLED display device 600 in accordance with an exemplary embodiment of the invention, which comprises a pixel array 602, a driver module 604 and a microcontroller 606. The pixel array 602 is implemented by the OLED pixel circuit of the disclosure. The driver module 60 is controlled by the microcontroller 606 to drive the pixel array 602 to display images.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An OLED pixel circuit, comprising:

a first switch transistor, a driving transistor and an OLED, wherein the first switch transistor, the driving transistor and the OLED are connected in series between a first operating voltage terminal and a second operating voltage terminal, the first switch transistor is controlled by a first signal, and a first terminal and a second terminal of the driving transistor are coupled to the first switch transistor and the OLED respectively, and the driving transistor has a control terminal;

a second switch transistor, coupled between the first terminal and the control terminal of the driving transistor and controlled by a second signal;

a third switch transistor, controlled according to a signal at a scan line to convey a signal from a data line to a circuit node;

a first capacitor, coupled between the circuit node and the control terminal of the driving transistor; and a switch circuit, controlled according to a third signal to couple the second terminal of the driving transistor to a control voltage level, wherein the first signal comprises a first stage enable interval and a second stage enable interval;

the first stage enable interval of the first signal is prior to an enable interval of the second signal;

the second stage enable interval of the first signal is later than a pixel data write interval;

an enable interval of the third signal cover the first stage enable interval of the first signal and the enable interval of the second signal; and the control voltage level is fixed at a specific voltage level during the enable interval of the second signal to pull down a voltage level at the second terminal of the driving transistor.

2. The OLED pixel circuit as claimed in claim 1, wherein the switch circuit comprises:

a fourth switch transistor, controlled according to the third signal to couple the second terminal of the driving transistor to the control voltage level, wherein the specific voltage level for setting the control voltage level is provided by a reference power source or the first signal.

3. The OLED pixel circuit as claimed in claim 1, wherein: the enable interval of the third signal covers the pixel data write interval.

4. The OLED pixel circuit as claimed in claim 1, wherein:

an enable interval of the signal at the scan line covers the first stage enable interval of the first signal, the enable interval of the second signal and the pixel data write interval; and a voltage data of the specific voltage level is conveyed by the data line during the first stage enable interval of the first signal and the enable interval of the second signal and a pixel data is conveyed by the data line during the pixel data write interval.

5. The OLED pixel circuit as claimed in claim 1, wherein the switch circuit comprises:

a fourth switch transistor, controlled according to the third signal to couple the circuit node to the control voltage level; and a fifth switch transistor, controlled according to the third signal to couple the second terminal of the driving transistor to the control voltage level, wherein the specific voltage level for setting the control voltage level is provided by a reference power source or the signal at the scan line.

6. The OLED pixel circuit as claimed in claim 1, wherein the switch circuit comprises:

a fourth switch transistor, controlled according to the third signal to couple the circuit node to the control voltage level; and a fifth switch transistor, controlled according to the third signal to couple the circuit node to the second terminal of the driving transistor, wherein the specific voltage level for setting the control voltage level is provided by a reference power source or the signal at the scan line.

7. The OLED pixel circuit as claimed in claim 1, wherein the switch circuit comprises:

a fourth switch transistor, controlled according to the third signal to coupled to the second terminal of the driving transistor to the control voltage level; and a fifth switch transistor, controlled according to the third signal to couple the circuit node to the second terminal of the driving transistor, wherein the specific voltage level for setting the control voltage level is provided by a reference power source or the signal at the scan line.

8. The OLED pixel circuit as claimed in claim 1, further comprising:

a second capacitor, coupled between the second terminal of the driving transistor and the circuit node.

9. The OLED pixel circuit as claimed in claim 8, wherein both the first and second capacitors are greater than a parasitic capacitor at the control terminal of the driving transistor.

10. The OLED pixel circuit as claimed in claim 1, further comprising:

a coupling capacitor, coupled between the first terminal of the driving transistor and a control terminal of the second switch transistor.

11. The OLED pixel circuit as claimed in claim 1, further comprising:

a coupling capacitor, coupling the first terminal of the driving transistor to the first operating voltage terminal or to the second operating voltage terminal or to a reference power source.

12. An OLED display device, comprising:

a pixel array, comprising the pixel circuit of claim 1;

a driver module, driving the pixel array; and a microcontroller, controlling the driver module to drive the pixel array.

* * * * *